US005626414A

United States Patent [19]

Chen

[11] Patent Number: 5,626,414

[45] Date of Patent: May 6, 1997

[54] FOLDING KNIFE WITH LASER INDICATOR

[76] Inventor: Shun-fu Chen, No. 6, Alley 8, Lane 162, Kuang Hua Rd., Lu Chou, Taipei Hsien, Taiwan

[21] Appl. No.: 631,192

[22] Filed: Apr. 12, 1996

[51] Int. Cl.[6] ..... F23D 5/12

[52] U.S. Cl. ..... 362/119

[58] Field of Search ..... 362/119

[56] References Cited

U.S. PATENT DOCUMENTS

| | | | |
|---|---|---|---|
| 5,402,575 | 4/1995 | Maxcy | 362/119 |
| 5,442,529 | 8/1995 | Hoover | 362/119 |
| 5,467,256 | 11/1995 | Chen | 362/119 |

*Primary Examiner*—Carroll B. Dority
*Attorney, Agent, or Firm*—Beveridge, DeGrandi, Weilacher & Young LLP

[57] ABSTRACT

Disclosed is a folding knife with laser indicator mainly including two cases, a blade, and a laser indicating means. The laser indicating means includes a supporting plate pivotally connected to and between the two cases. A long recess is formed in the supporting plate to receive a springy conductive plate, a laser emitter, and a series of cells therein. The laser emitter has a laser diode and a focusing lens in it and has a spring provided to its inner end to contact with one pole of the cells. The conductive plate extends along an inner wall of the recess and has one end contacting with another pole of the cells and the other end extending to a point near an electrical contact of the laser emitter, such that a depression of a push button provided on an outer wall of the supporting plate shall press the conductive plate against the electrical contact of the laser emitter, electrically connecting the laser diode to emit light beam which passes through a hole formed at an outer end of the supporting plate.

2 Claims, 5 Drawing Sheets

FOLDING KNIFE WITH LASER INDICATOR

BACKGROUND OF THE INVENTION

1. Field of the Invention

The present invention relates to a folding knife, and more particularly to a folding knife with laser indicator. The laser indicator is pivotally mounted between a pair of cases and may be easily turned out of the cases for replacement of new cells.

2. Description of the Prior Art

Generally, a folding knife usually includes a pair of cases and a blade which may be received between the cases or be pivotally turned out of the cases for use.

In the U.S. Pat. No. 5,467,256 granted to the applicant, a knife with lighting fixture is disclosed. The knife mainly consists of a pair of cases, a pivotally turnable knife, and a pivotally turnable supporting plate. The supporting plate has a cell, a bulb, and a push button supported thereon. The push button is slightly projected from one of the case so that a depression of it may lighten the bulb to shine toward the knife for convenient use in a dark place. The supporting plate may be easily turned out of the cases for mounting a new cell and/or a new bulb when necessary.

The lighting fixture in the knife disclosed in U.S. Pat. No. 5,467,256 is designed to include cells which are horizontally positioned and therefore, only limited numbers of cell can be loaded in the supporting plate to lighten only a small bulb. That is, such design can not supply sufficient power for a laser diode to emit a light beam.

Moreover, since the bulb of the knife disclosed in U.S. Pat. No. 5,467,256 has two pole pins separately extend to connect to the positive and the negative poles of the cell, it is necessary to remove the bulb along with the cell from the supporting plate when changing the cell. However, the elongated and narrow groove receiving the two pole pins of the bulb makes this operation very inconvenient. And, since the push button is disposed in the cases and on the cell seat of the supporting plate, it will more or less hinder the pull or push of the supporting plate from or into the cases.

SUMMARY OF THE INVENTION

It is therefore a primary object of the present invention to provide a folding knife with laser indicator in which more cells can be loaded to supply sufficient power for use by a laser diode.

Another object of the present invention is to provide a folding knife with laser indicator in which a supporting plate for mounting the cells and the laser indicator is improved to facilitate convenient replacement of new cells.

A further object of the present invention is to provide a folding knife with lasere indicator in which a push button is provided at one outer side wall of the supporting plate so that the push button would not hinder the operation of the knife and the replacement of cells.

The folding knife with laser indicator according to the present invention therefore includes an upper and a lower cases and a laser indicating means. The laser indicating means includes a supporting plate having a long recess and pivotally connected to and between the two cases for supporting multiple vertically positioned cells and a laser indicator in the recess. A springy conductive plate is positioned in the recess to extend along an inner wall thereof so as to connect a negative pole of the cells to a contact of the laser indicator. A push botton formed on an outer side wall of the supporting plate to normally contact with a front end of the conductive plate. When the push button is depressed, the conductive plate is pressed against the contact of the laser indicator, electrically connecting the laser diode inside the laser indicator to emit light.

BRIEF DESCRIPTION OF THE DRAWINGS

The present invention can be best understood by referring to the following detailed description of the preferred embodiments and the accompanying drawings, wherein.

DETAILED DESCRIPTION OF THE PREFERRED EMBODIMENTS

Figure 1:
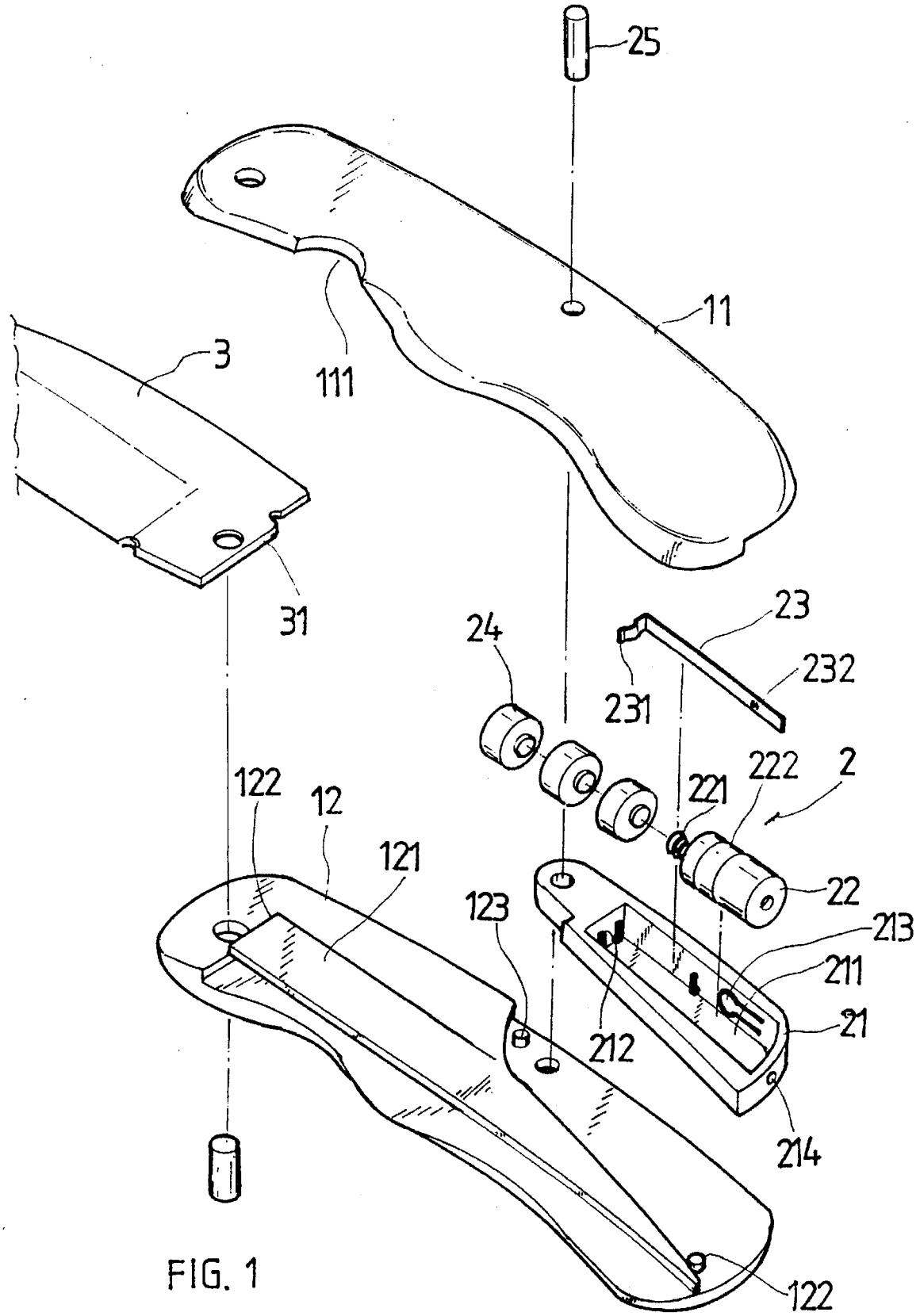
FIG. 1 is an exploded perspective of the present invention.
Figure 2:
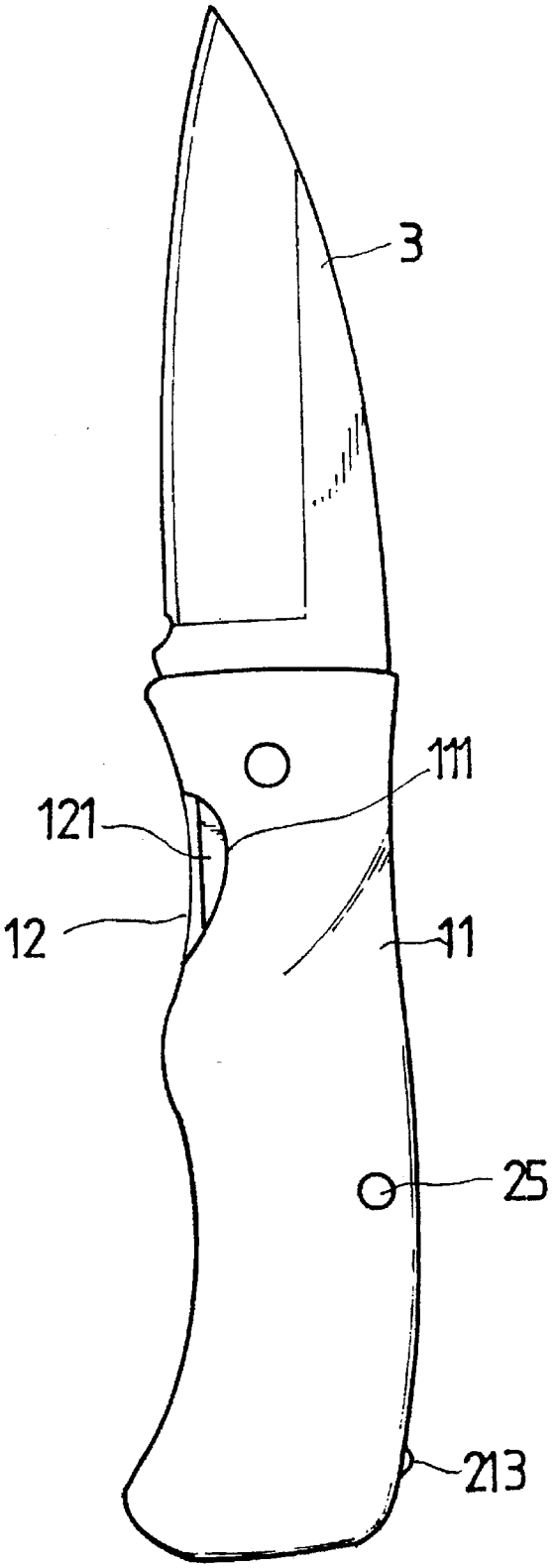
FIG. 2 is a plan view of the present invention in an assembled state.

Please refer to FIGS. 1 and 2. The present invention relates to a folding knife with laser indicator and mainly includes an upper and a lower cases 11, 12 having substantially symmetrical profile, a laser indicating means 2, and a blade 3.

Figure 3:
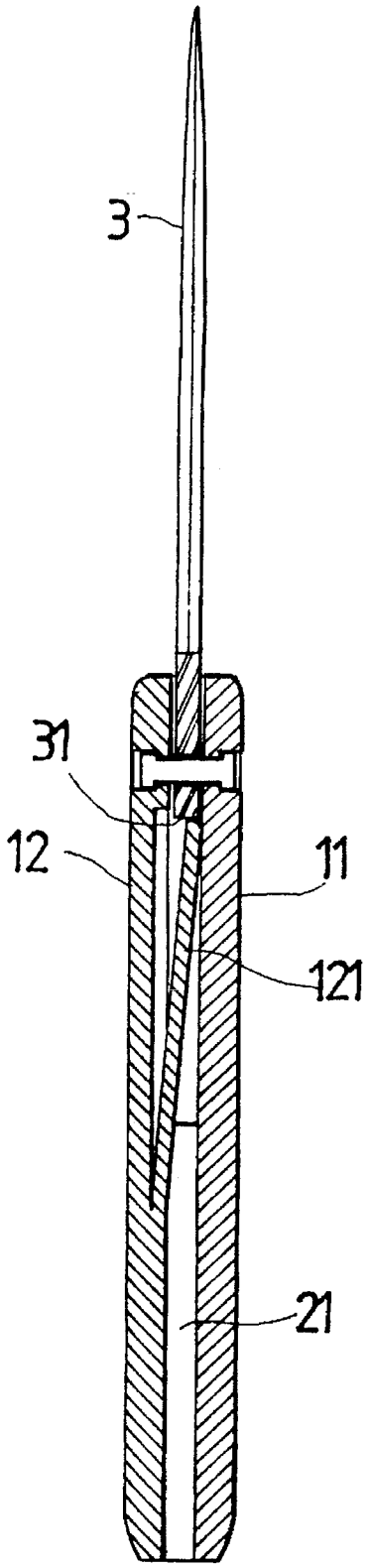
FIG. 3 is a side vertical sectional view of the present invention in an assembled state.

The blade 3 is pivotally connected to and between the upper and the lower cases 11, 12 by means of a pivotal shaft, so that the blade 3 can be received between the two cases 11, 12 or be pivotally turned out of the cases 11, 12 for use. The lower case 12 is formed on its inner surface with an inclined brake plate 121. When the blade 3 is pivotally turned out of the cases 11, 12, a distal edge 122 of the blade 3 shall abut against a rear edge 31 of the extended blade 3 and thereby holds the blade 3 in place without turning, as shown in FIG. 3.

The upper case 11 is formed at one side with a dent 111, allowing the brake plate 121 to show up a small part from the dent 111. A user may press the showed part of the brake plate 121 with a finger via the dent 111, so that the distal edge 122 of the inclined brake plate 121 disengages from the rear edge 31 of the blade 3, allowing the blade 3 to be folded back into the two cases 11, 12.

Figure 4:
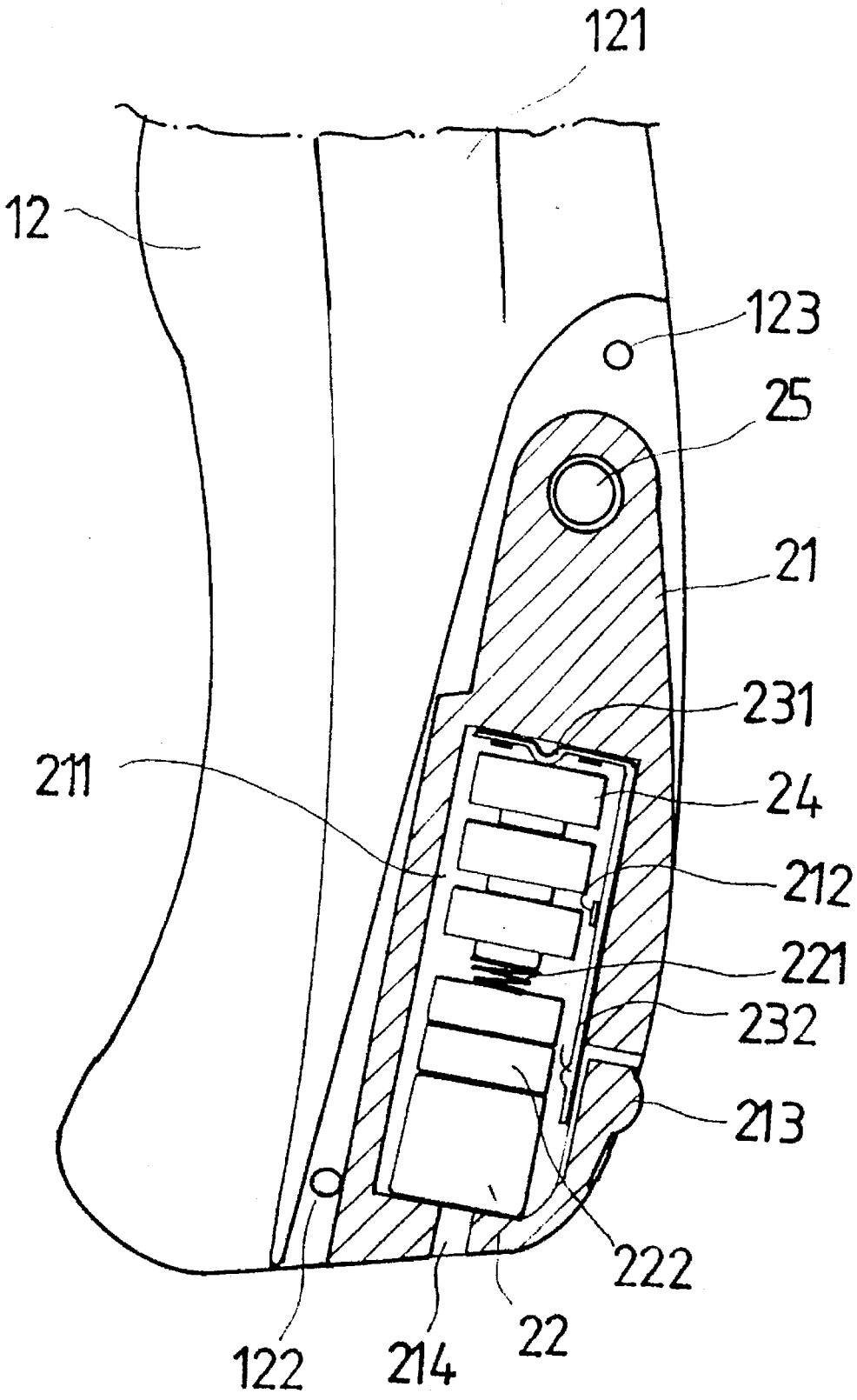
FIG. 4 is a fragmentary, enlarged, partially sectional view showing the portion of the present invention where the laser indicator is mounted.

Please now refer to FIGS. 1 and 4 for a structure of the laser indicating means 2. The laser indicating means 2 includes a supporting plate 21 pivotally connected to and between the two cases 11, 12, a laser emitter 22, a springy conductive plate 23, and a series of cells 24.

The supporting plate 21 is pivotally connected between the upper and the lower cases 11, 12 by means of a pivotal shaft 25. The supporting plate 21 is limited to pivotally turn within a scope defined by two bosses 122, 123 provided on the inner surface of the lower case 12, as shown in FIG. 1. A long recess 211 is formed on the supporting plate 21 for receiving the cells 24 and the laser emitter 22 therein. The springy conductive plate 23 is disposed in the recess 211 to extend along an inner wall thereof. A bent end 231 of the conductive plate 23 is retained to an inner end of the recess 211 by retaining means 212 to contact with the series of cells 24. The laser emitter 22 has a spring 221 provided to an inner end thereof. The spring 221 and the bent end 231 of the springy conductive plate 23 together hold the cells 24 in place in the recess 211. An extension portion of the plate 23 extends to a point near a conductive contact 222 of the laser emitter 22 with a protuberance 232 on the extension portion of the plate 23 normally separating from the contact 222, as shown in FIG. 4. At this point, a laser diode inside the laser emitter 22 is not electrically connected and therefore, the laser emitter 22 does not emit indicating light spot. Of course, there are still some other necessary parts, including a controlling circuit, a laser diode, a focusing lens, etc., in the laser emitter 22.

Figure 5:
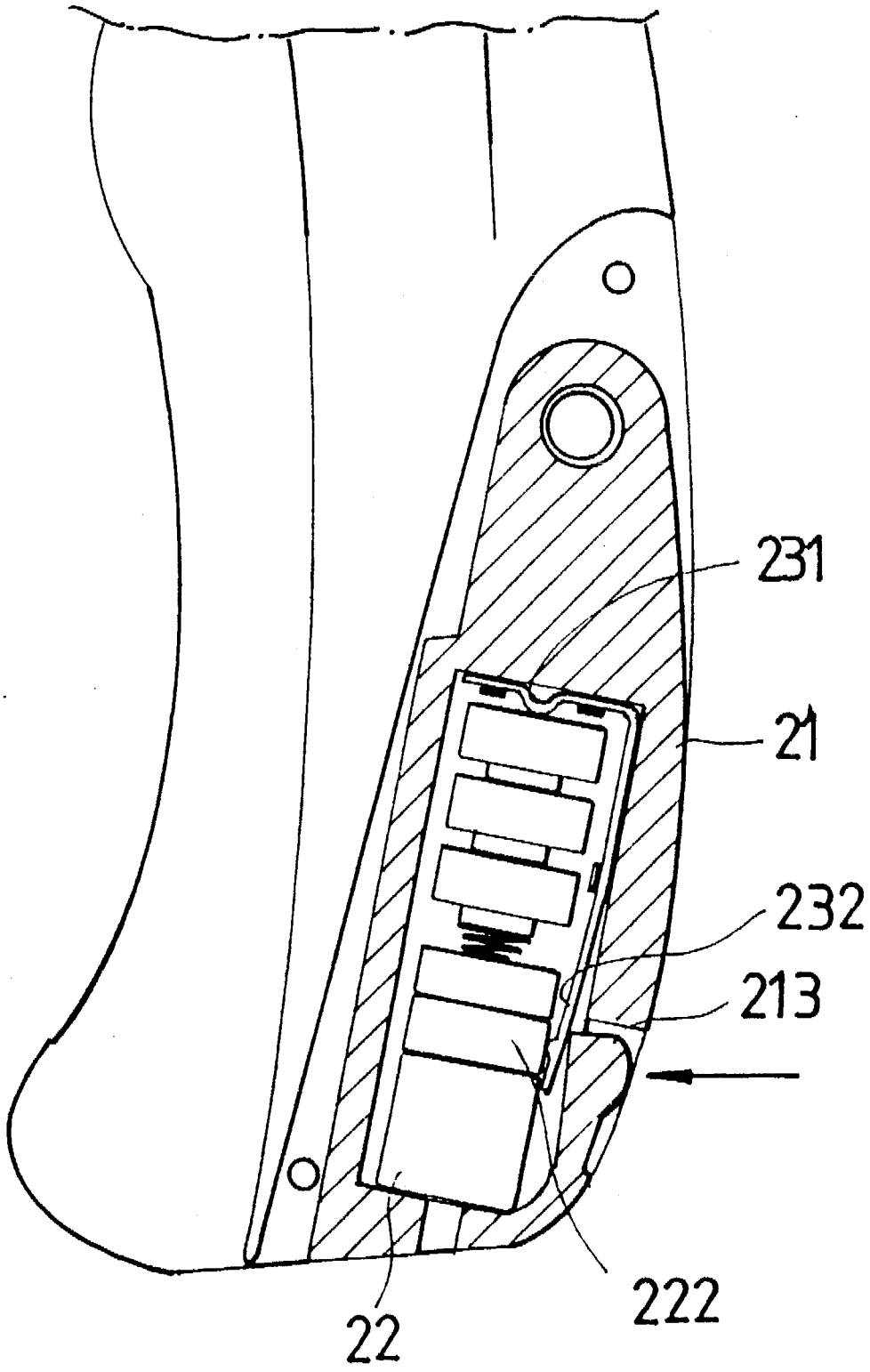
FIG. 5 is similar to FIG. 4 but with the push button being depressed.

A push button 213 is formed at one outer side wall of the supporting plate 21 to slightly project from the periphery of the cases 11, 12. The push button 213 is located at a point just outside the protuberance 232 of the conductive plate 23 and the contact 222 of the laser emitter 22. Thereby, a depression of the push button 213 shall make the diode inside the laser emitter 22 electrically connected and to emit indicating light spot, as shown in FIG. 5. A through hole 214 is formed at an outer edge of the supporting plate 21 for the light beam emitted by the laser emitter to pass therethrough.

Figure 6:
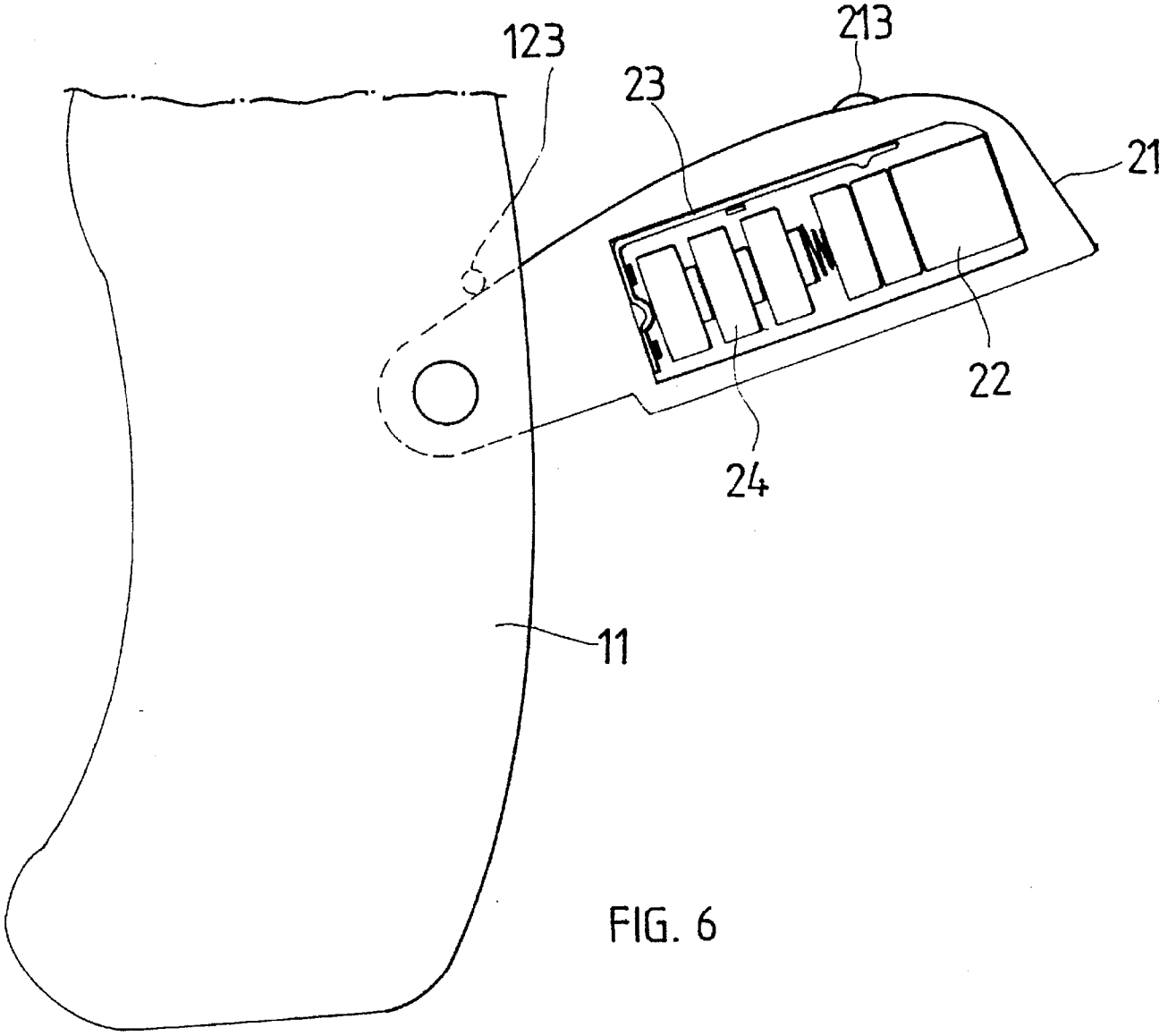
FIG. 6 illustrates the manner in which the supporting plate is pivotally turned out of the cases of the knife.

Since the laser indicating means 2 is pivotally connected between the two cases 11, 12, it may be turned to be received in the cases 11, 12 or be turned out of the cases 11, 12 for convenient replacement of the cells 24, as shown in FIG. 6. The bosses 122, 123 are located on the inner surface of the lower case 12 near the outer and an inner end of the supporting plate 21, respectively. The boss 122 serves as a stopper at where the folded supporting plate 21 is stopped from further moving inward, as shown in FIG. 4, and thereby facilitates the next pivotal turning of the supporting plate 21 out of the cases 11, 12. The other boss 123 serves as a stopper at where the extended supporting plate 21 is stopped from further turning outward, as shown in FIG. 6.

What should be noted is the spring 221 provided at the inner end of the laser emitter 22 provides sufficient tension to allow the cells 24, the laser emitter 22 and the springy conductive plate 23 to be firmly held in the recess 211 without easily becoming loosed. To replace the cells 24, simply lightly push the cells and the cells 24 can be easily removed from the recess 211.

In another embodiment of the present invention, a bulb is used to replace the laser emitter 22 and forms a lighting fixture in the folding knife of the present invention.

What is claimed is:

1. A folding knife with laser indicator, comprising an upper and a lower cases, a blade pivotally connected to and between said cases, and a laser indicating means pivotally connected to and between said two cases;

said lower case being formed on an inner surface with an inclined brake plate, said upper case being formed at one side with a dent to expose a small part of said brake plate so that said brake plate may be depressed with a finger via said dent;

said blade being allowed to be pivotally turned into and between said two cases or be pivotally turned out of said cases with said brake plate abutting a distal edge against a rear edge of said extended blade to prevent said blade from moving at the extended position; and said laser indicating means further comprising a supporting plate pivotally connected to and between said two cases and formed with a long recess, a laser emitter disposed in said long recess of said supporting plate and having a laser diode, a controlling circuit, and a focusing lens mounted therein, a series of cells disposed in said long recess opposite to said laser emitter, a spring provided to an inner end of said laser emitter to contact with said series of cells, and a springy conductive plate disposed in said long recess along an inner wall thereof with a bent end contacting with said cells and an extension part extending to a point near a conductive contact of said laser emitter; said supporting plate being provided at an outer side with a push button slightly projected from an outer periphery of said supporting plate, and depression of said push button allowing said push button to press said extension part of said springy conductive plate against said contact on said laser emitter and thereby electrically connects said laser diode in said laser emitter for said laser emitter to emit light spot from a through hole provided to an outer end of said supporting plate.

2. A folding knife with laser indicator as claimed in claim 1, wherein said lower case is formed on said inner surface near an inner end and an outer end of said supporting plate each with a boss, said boss near said outer end of said supporting plate serving as a stopper at where said supporting plate of said laser indicating means is prevented from further moving inward when it is folded toward said cases, and said boss near said inner end of said supporting plate serving as a stopper at where said supporting plate is prevented from further moving outward when it is extended from said cases.

* * * * *